United States Patent [19]

Dragone

[11] Patent Number: 4,607,260

[45] Date of Patent: Aug. 19, 1986

[54] ASYMMETRICALLY CONFIGURED HORN ANTENNA

[75] Inventor: Corrado Dragone, Little Silver, N.J.

[73] Assignee: AT&T Bell Laboratories, Murray Hill, N.J.

[21] Appl. No.: 626,521

[22] Filed: Jun. 29, 1984

[51] Int. Cl.[4] ..... H01Q 19/13

[52] U.S. Cl. ..... 343/786; 343/840

[58] Field of Search ..... 343/786, 781 R, 840, 343/756

[56] References Cited

U.S. PATENT DOCUMENTS

| | | | |
|---|---|---|---|
| 2,817,837 | 12/1957 | Dale et al. | 343/775 |
| 2,959,784 | 11/1960 | Pierce | 343/783 |
| 3,510,873 | 5/1970 | Trevisan | 343/781 |
| 3,646,565 | 2/1972 | Robinson, Jr. et al. | 343/781 |
| 3,936,837 | 2/1976 | Coleman et al. | 343/781 |
| 3,949,404 | 4/1976 | Fletcher et al. | 343/761 |
| 4,047,287 | 9/1977 | Hubbard et al. | 29/600 |
| 4,398,200 | 8/1983 | Meier | 343/786 |
| 4,410,892 | 10/1983 | Knop et al. | 343/786 |

OTHER PUBLICATIONS

Crawford et al. BSTJ, vol. 40 No. 4, Jul. 1961, pp. 1095–1116.

Takeichi et al.—1970 G-AP, Columbus, Ohio, Sep. 14–16, 1970, pp. 41–47.

Thomas—1972 G-AP, Williamsburg, Va., Dec. 11–14, 1972, p. 137.

*Primary Examiner*—Eli Lieberman

*Assistant Examiner*—Michael C. Wimer

*Attorney, Agent, or Firm*—Erwin W. Pfeifle

[57] ABSTRACT

The present invention relates to a horn antenna which provides minimized cross-polarization in the far field of the antenna. The antenna arrangement comprises a horn including four walls wherein a first pair of opposing concentric conic walls are associated with a common longitudinal axis, and a second pair of opposing planar walls are aligned radially to the common longitudinal axis of the cones. The walls taper down from an offset parabolic main reflector to intersect a common apex corresponding to a focal point of the main reflector. The longitudinal axis of the horn is arranged at a predetermined angle to the common longitudinal axis of the cones to minimize cross-polarization in either one or both of the $TE_{01}$ or $TE_{10}$ modes in the far field of the antenna.

6 Claims, 8 Drawing Figures

ASYMMETRICALLY CONFIGURED HORN ANTENNA

TECHNICAL FIELD

The present invention relates to a horn antenna which provides reduced cross-polarization components in the far-field by arranging the four walls of the horn in an asymmetric configuration. More particularly, in cross-section, the four walls of the horn comprise two opposing radially aligned planar walls and two opposing concentric conic walls which taper to a common apex to form the waveguide section between the narrow feed end and a wide offset main parabolic reflector. The longitudinal axis of the horn is aligned in a predetermined manner with respect to the common longitudinal axis of the concentric conic walls forming the horn to minimize cross-polarized components over the antenna aperture.

DESCRIPTION OF THE PRIOR ART

As described in the article "A Horn-Reflector Antenna for Space Communication" by A. B. Crawford et al in *BSTJ*, Vol. 40, No. 4, July 1961 at pages 1095–1116, a conventional horn reflector has only one plane of symmetry. Such horn reflector, as shown in present FIG. 1, consists of a square horn combined with an offset paraboloid. The angle of incidence for the central ray corresponding to the horn axis is 45 degrees, and the antenna aperture is a curvilinear trapezoid with only one line of symmetry, which is the y-axis shown in FIG. 1. A problem arising in FIG. 1 is that the horn dominant modes ($TE_{01}$ and $TE_{10}$) do not produce the same polarization everywhere over the entire aperture. In fact, only on the symmetry line will the polarization be produced correctly, as at the center of the aperture. At points which are not on the symmetry line, the polarization will be rotated by the angle $\gamma_{TE01}$ or $\gamma_{TE10}$ shown in FIG. 1. This rotation will cause, for both fundamental modes $TE_{01}$ and $TE_{10}$, an undesirable field component with the polarization orthogonal to the field at the center of the aperture, thus reducing cross-polarization discrimination in the antenna far-field.

U.S. Pat. No. 2,817,837 issued to G. V. Dale et al on Dec. 24, 1957 discloses a large horn reflector described as a "sectoral bi-conical horn". There, the horn includes outwardly-concave, conically-shaped, front and rear surfaces and flat side surfaces. The horn arrangement is allegedly designed to provide an improved impedance versus frequency characteristics along with substantially no tendency to become distorted by temperature changes.

Other horn antenna arrangements have been designed using a conical horn section as disclosed, for example, in U.S. Pat. Nos. 3,510,873 issued to S. Trevisan on May 5, 1970; 3,646,565 issued to G. P. Robinson, Jr. et al on Feb. 29, 1972; and 3,936,837 issued to H. P. Coleman on Feb. 3, 1976.

The problem remaining is to provide a horn antenna in which cross-polarization is substantially reduced for at least one of the two fundamental modes ($TE_{01}$ and $TE_{10}$) thus permitting superior performance in cross-polarization discrimination in the antenna farfield.

SUMMARY OF THE INVENTION

The foregoing problem has been solved in accordance with the present invention which relates to a horn antenna which reduces substantially cross-polarization by arranging the four walls of the horn in a predetermined asymmetric configuration.

It is an aspect of the present invention to provide a horn antenna which provides reduced cross-polarization in the far field wherein the four walls of the horn comprise two opposing radially aligned planar walls and two opposing concentric conic walls which are orthogonal to the two planar walls and taper to a common apex to form the waveguide section between the narrow feed end and a wide offset main parabolic reflector. The longitudinal axis of the horn is aligned at a predetermined angle to the common axis of the conic walls forming the horn to minimize cross-polarization over the antenna aperture.

Other and further aspects of the present invention will become apparent during the course of the following description and by reference to the accompanying drawings.

BRIEF DESCRIPTION OF THE DRAWINGS

Referring now to the drawings in which like numerals represent like parts in the several views.

DETAILED DESCRIPTION

Figure 1:
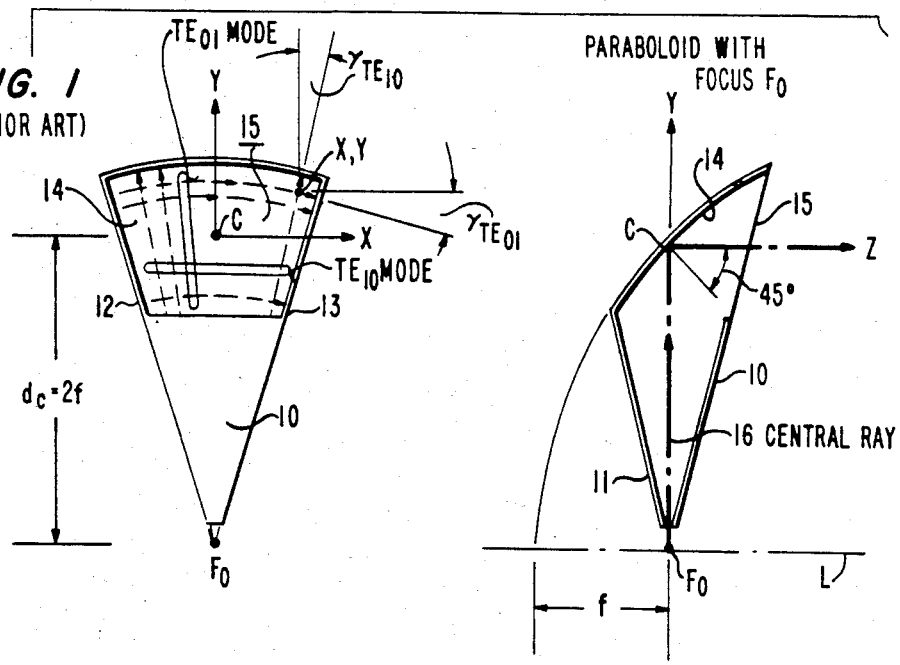
FIG. 1 (PRIOR ART)
FIG. 1 is a cross-sectional view in two orthogonal planes of a conventional horn-reflector antenna.

FIG. 1 illustrates a cross-sectional view in two orthogonal planes of a conventional horn reflector antenna arrangement. The antenna comprises a square horn including a planar front and back wall 10 and 11 all four walls tapering out from a focal point F of an offset parabolic reflector 14 disposed at the top of the horn. The antenna aperture 15 is provided by the boundary of the front wall 10, the two side walls 12 and 13 and the upper edge of parabolic reflector 14.

The angle of incidence for a central ray corresponding to the horn axis 16 is 45 degrees, and the antenna aperture 15 has only one line of symmetry, the y-axis shown in FIG. 1. For an aperture point x,y, the polarization angle $\gamma$ in FIG. 1 is approximately given for both fundamental modes $TE_{01}$ and $TE_{10}$ by $$\tan \gamma = x/2f \tag{1}$$

in the vicinity of the center C of parabolic reflector 14.

Figure 2:
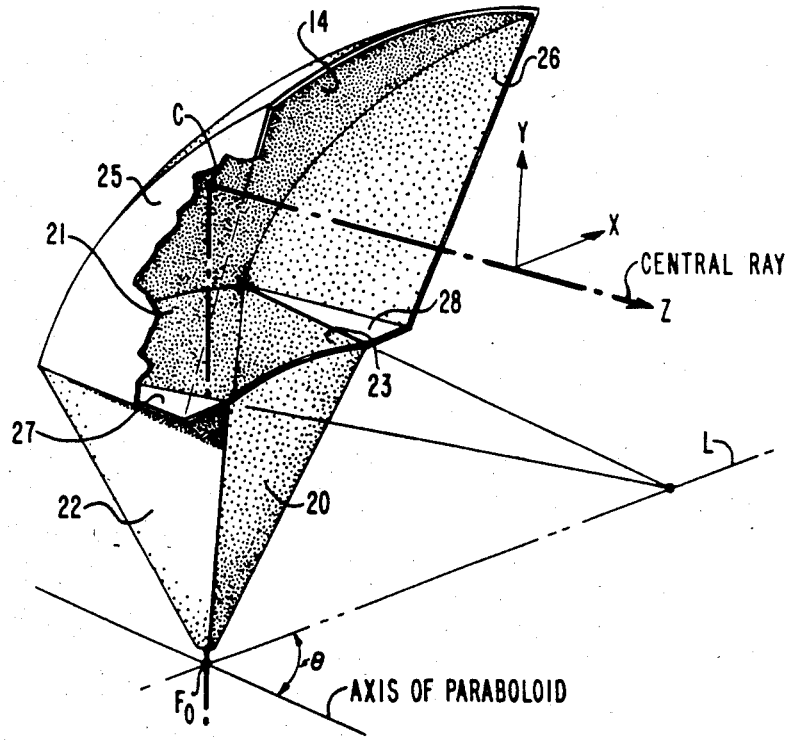
FIG. 2 is a view in perspective of a horn-reflector antenna in which cross-polarization has been minimized in accordance with the present invention.

FIG. 2 illustrates a view in perspective of a horn reflector antenna arrangement in accordance with the present invention to provide an antenna with minimal cross-polarization over the antenna aperture. More particularly, the symmetric aperture is achieved by an antenna arrangement which comprises an offset parabolic reflector 14 with a horn including an asymmetric geometry, i.e., only one plane of symmetry which is in the y-axis plane. The horn section comprises a front and back wall 20 and 21 disposed orthogonal to the symmetry plane, walls 20 and 21 being coaxial circular cone sections having a common apex and a common axis of symmetry designated as line L. The left and right side walls 22 and 23 of the horn are planar and intersect each other along a line L that passes through focal point $F_0$ and is oriented at an angle $\theta$ to the axis of revolution of parabolic reflector 14.

It should be noted that in both FIGS. 1 and 2, the horn sidewalls are two planes, intersecting each other along a line L. However, in FIG. 1 the line L is orthogonal to the central ray, whereas in FIG. 2 the line L is inclined at an angle $\theta$ which will be chosen to minimize cross-polarization over the antenna aperture. It should be further noted that in FIG. 1, the two side walls 12 and 13 extend up to reflector 14, whereas this is not possible in the arrangement of FIG. 2 for otherwise some of the reflected rays would be blocked by the sidewalls. For this reason, side walls 25 and 26 are extended straight out from the side edges of reflector 14 and connected with triangular ledges 27 and 28 to side walls 22 and 23, respectively.

Figure 5:
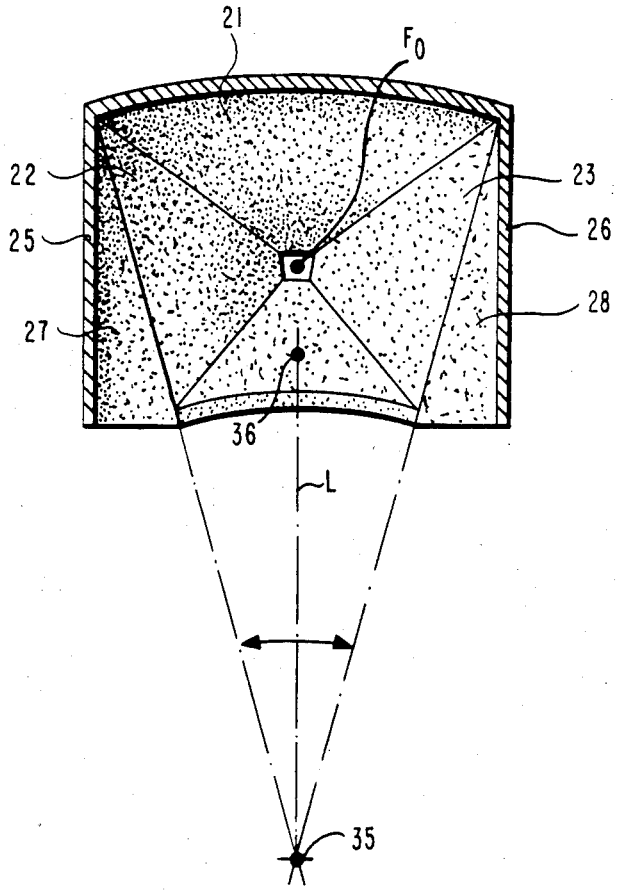
FIG. 5 is a top view of the horn-reflector antenna of FIG. 2 looking down the throat of the horn from the area of the reflector.
Figure 7:
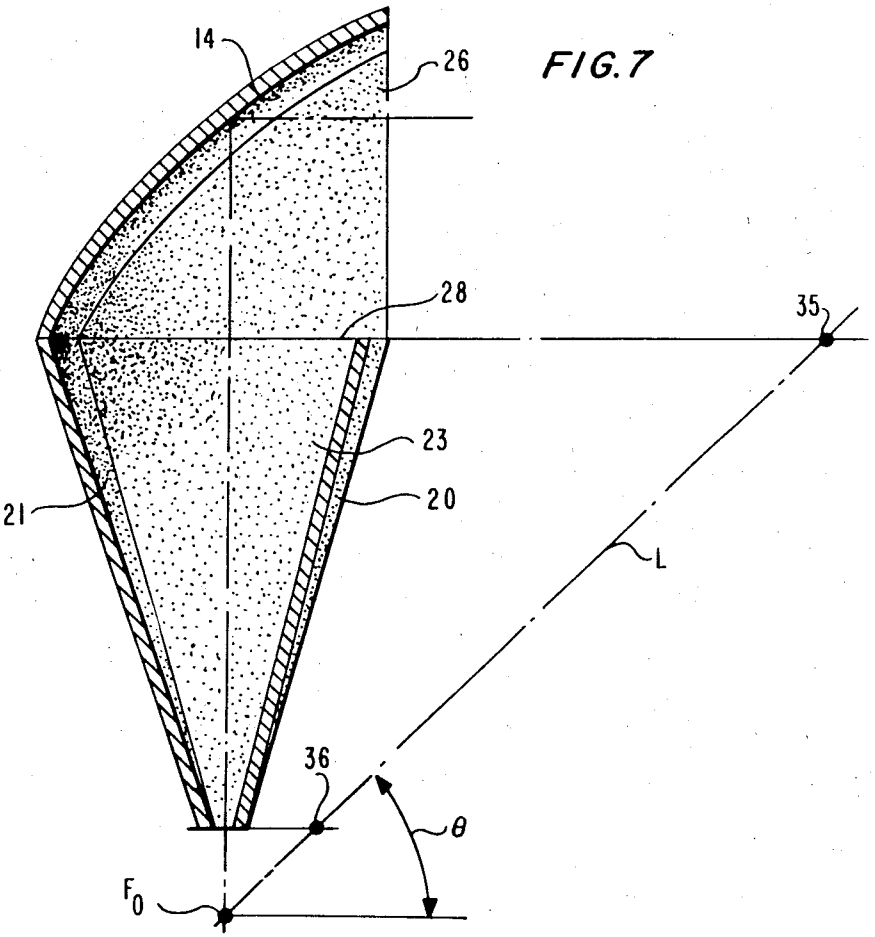
FIG. 7 is a cross-sectional side view of the horn-reflector antenna of FIG. 2.
Figure 6:
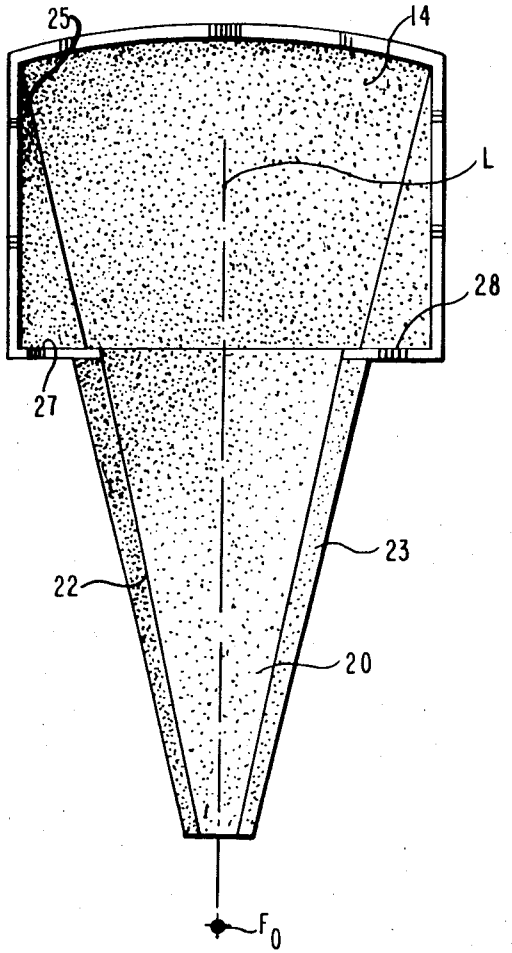
FIG. 6 is a cross-sectional front view of the horn-reflector antenna of FIG. 2.

FIG. 5 shows a top view of the level of triangular ledges 27 and 28 looking down the throat of the horn, with walls 20 and 21 being separately curved when proceeding along the longitudinal axis of the horn using a common axis of symmetry along line L. For example, at the level of ledges 27 and 28, front and back walls are curved to a common apex 35 on line L while at the bottom of the horn walls 20 and 21 are curved to the common apex 36 on line L. FIG. 6 shows a front view and FIG. 7 shows a side view of the horn in cross section to more clearly show this concept.

Figure 3:
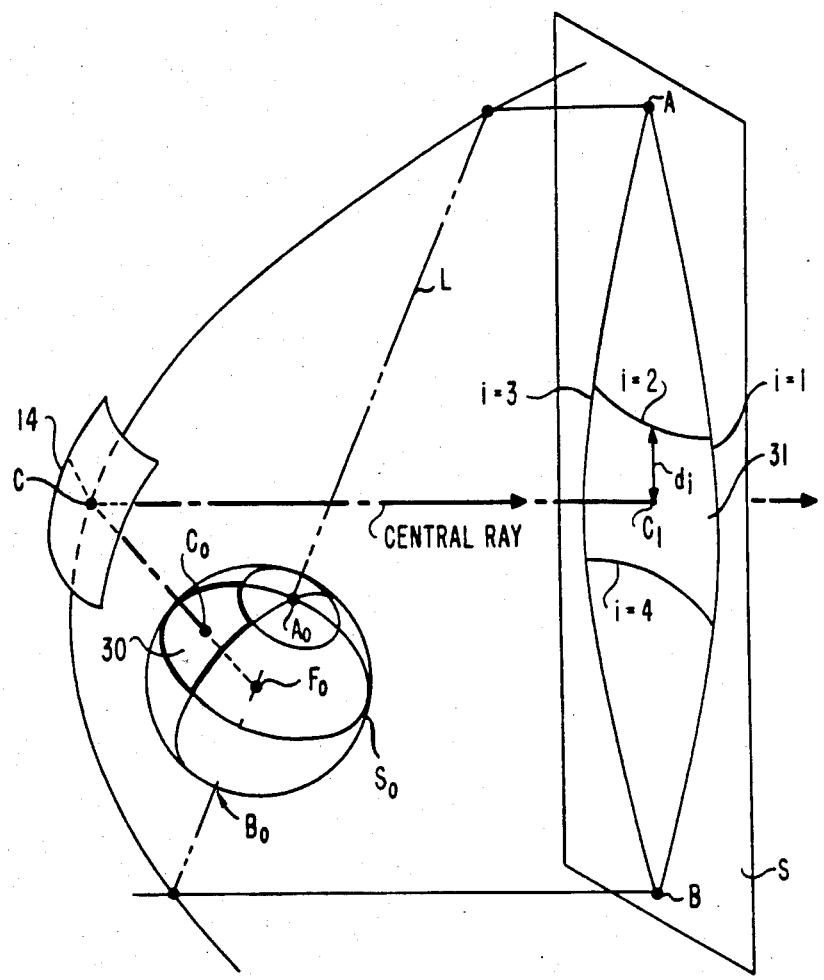
FIG. 3 illustrates the asymmetric quadrilateral corresponding to the horn aperture in the arrangement of FIG. 2 which is transformed by the parabolic reflector into a quadrilateral with two lines of symmetry thus minimizing cross-polarization for the $TE_{01}$ mode.

An important property of the assymmetric horn geometry in FIG. 2 is that the polarization lines for the $TE_{01}$ to $TE_{10}$ modes will not be orthogonal over the aperture. This will cause different values for the angle of polarization rotation for the two modes ($\gamma_{TE01}$ and $\gamma_{TE10}$) at any point over the antenna aperture. Therefore, the optimum horn geometry which minimizes $\gamma_{TE01}$ does not minimize $\gamma_{TE10}$ and vice versa. Thus, a different value must be chosen for the angle $\theta$ of FIG. 2 depending on whether (1) only the $TE_{01}$ mode is used, (2) only the $TE_{10}$ mode is used, or (3) both modes are used. The horn geometry will be the same in all cases, only the value of $\theta$ will be different. The discussion which follows relates to case (1) above where only the $TE_{01}$ mode is used. The same technique, however, also applies to cases (2) and (3) above provided the value of $\theta$ is properly adjusted in each case as will become clear during the course of the following description. For case (1), the polarization lines for the $TE_{01}$ mode are orthogonal to a family of circles through two common points and the angle of rotation $\gamma_{TE01}$ is minimized when the two points are symmetrically located with respect to the center of the antenna aperture. Then, the aperture becomes a curvilinear quadrilateral as shown in FIG. 3.

To derive the antenna arrangement with minimal cross-polarization for the $TE_{01}$ mode in accordance with the present invention, the line L in FIG. 2 should be chosen so as to obtain two lines of symmetry over the antenna aperture. In FIG. 3 there is shown a paraboloid 14 illuminated by a spherical wavefront $S_o$. The center of illumination $C_o$ is determined by the central ray, and the line L intersects wavefront $S_o$ at two antipodal points $A_o$, $B_o$. On a reflected wavefront S according to geometric optics, let $C_1$, A, and B denote the points corresponding to $C_o$, $A_o$, $B_o$. In order to obtain two symmetry lines through $C_1$, the line L must be oriented so that points A and B are symmetrically located with respect to $C_1$. It is assumed that the paraboloid 14 is illuminated by a horn realized using two planes through L and two circular cones orthogonal to the two planes. Thus, the horn boundary on wavefront $S_o$ is a quadrilateral 30 consisting of four orthogonal circles, of which two pass through the antipodal points $A_o$ and $B_o$. Also, the corresponding quadrilateral 31 on reflected wavefront S consists of four orthogonal circles, and these circles are uniquely determined by their distances $d_i$ from $C_1$, and by the locations of A, B. Clearly, a symmetrical 31 will be obtained by choosing $d_1=d_3$ and $d_2=d_4$, provided the two points A, B are symmetrically located with respect to $C_1$. Next, the required angle $\theta$, is determined between the line L and the parabloid axis. To do this, let a, b, and c be the distances of points A, B, and $C_1$ from the paraboloid axis. Then, referring to FIG. 4, $$a = \frac{2f}{\tan\frac{\theta}{2}},\ b = 2f\tan\frac{\theta}{2},\ c = 2f\tan\theta_c/2 \tag{2}$$

where $\theta_c/2$ is the angle of incidence for the central ray. In order that point $C_1$ be the midpoint of A, B, one must have $2(a-b)=c$, which requires $$\theta=90^\circ-\theta_c/2 \tag{3}$$

Then the distance d of point $C_1$ from point A (or point B) is $$d = \frac{2f}{\cos\frac{\theta_c}{2}} \tag{4}$$

Figure 4:
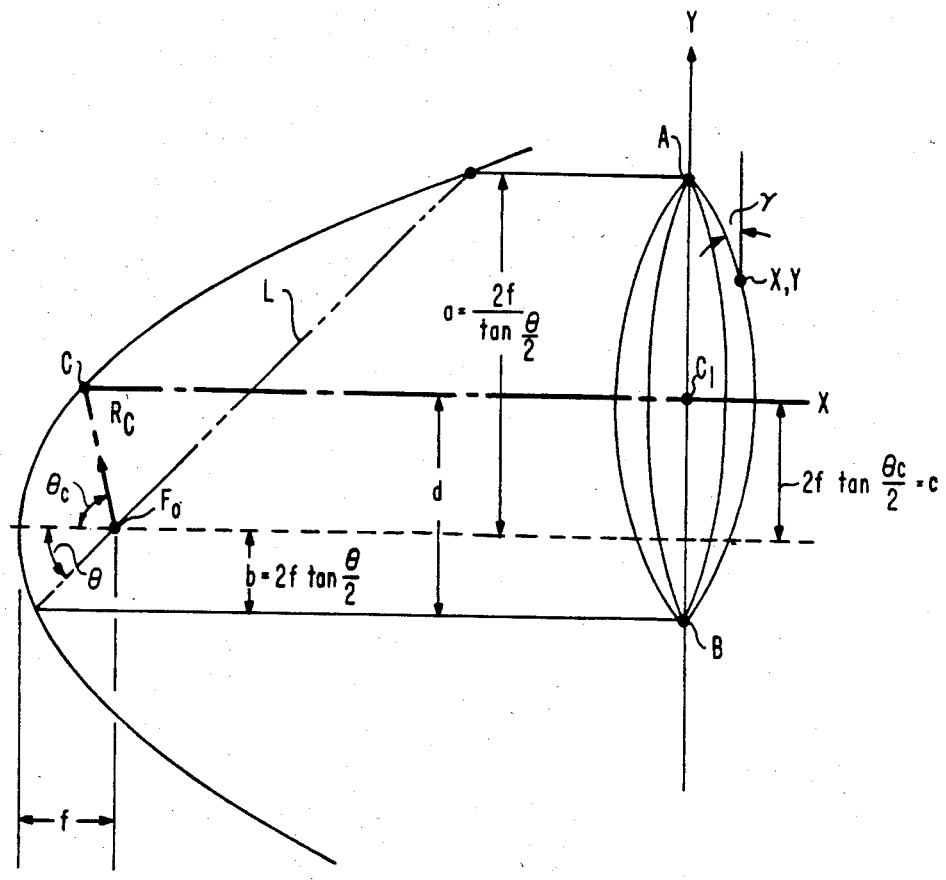
FIG. 4 illustrates the relationship between a, b and c, and $\theta$ and $\theta_c$ in the arrangement of FIGS. 2 and 3 when cross-polarization is minimized for the $TE_{01}$ mode.

For a point of coordinates x,y the angle $\gamma$ in FIG. 4 is given by $$\tan\gamma = \frac{2xy}{d^2+x^2-y^2} \tag{5}$$

In the conventional horn reflector, $\theta_c=45^\circ$ and then Equation (3) requires $\theta=45^\circ$.

For the $TE_{01}$ mode, one can show from the book by R. F. Harrington, *Time-Harmonic Electromagnetic Fields*, McGraw-Hill, 1961, at pages 264–285 that the polarization lines over the sphere in FIG. 3 are coaxial circles centered around the line L. The polarization lines after reflection are, therefore, a family of circles orthogonal to the two circles which in FIG. 3 pass through points A and B with i=1 and i=3. It follows that the field produced by the $TE_{01}$ mode in FIGS. 2 and 4 will be horizontally polarized on both symmetry lines x=0 and y=0. Over the aperture of the conventional horn reflector as shown in FIG. 1, instead, the field will be horizontally polarized only on the symmetry line x=0. Furthermore, the angle of rotation $\gamma_{TE01}$ at a point of coordinate x,y is given according to Equation (5) for small x,y by $$\tan\gamma \simeq 2xy/d^2 \tag{6}$$

which is much smaller (since $x,y << d$) than the value given by Equation (1).

From the foregoing, it can be seen that the above condition requires that the axis of the two conical wall sections 20 and 21, the horn axis 16 and the paraboloid axis of revolution, satisfy Equation (3). It should be noticed that the central ray is the ray corresponding to the horn axis, and $\theta_c$ in Equation (3) is twice the angle of incidence for this ray. Once $\theta_c$ is chosen, from Equation (3) one obtains the angle $\theta$ specifying the location of the axis of symmetry of the two conical wall sections 20 and 21 relative to the axis of revolution of the reflecting surface, or vice versa. The horn consists of two conical walls and two planar walls passing through the axis of the two conical wall sections 20 and 21. The four walls determine the boundary of the antenna aperture, which will have two symmetry lines provided the four walls are properly chosen so that the four walls of the boundary are at equal distances ($d_1=d_2=d_3=d_4$ in FIG. 3) from the center of the aperture. This horn antenna supports two fundamental modes $TE_{01}$ and $TE_{10}$. For the $TE_{01}$ mode, the electric field over the aperture will be essentially orthogonal to the circles shown in FIG. 4 through points A and B. Thus, this mode will produce an electric field polarized, to a good approximation, in one direction everywhere over the entire antenna aperture. This property is needed in order to obtain good discrimination between vertical and horizontal polarization in an antenna using only the $TE_{01}$ mode.

The above-mentioned antenna, with $\theta$ chosen according to Equation (3), is only suitable when operation in the $TE_{10}$ mode is not required. Otherwise, one finds by the method disclosed in the book by Harrington, mentioned hereinbefore, that the angle of rotation, $\gamma_{TE_{10}}$, in the vicinity of the center of the aperture is proportional to the coefficient $m=m_1+m_2$ where $$m_1 = \left(\tan\frac{\theta_c}{2} - \tan\gamma\right)\frac{1}{\cos\gamma}, \tag{7}$$

$$m_2 = -\left(\frac{\pi}{2}\right)^2 \sin\gamma \tag{8}$$

$$\gamma = \theta_c + \theta - 90^\circ \tag{9}$$

For the $TE_{01}$ mode, on the other hand, the coefficient m is given by $m_1$. Thus, by choosing $\theta$ according to Equation (3), one obtains $m=0$ for the $TE_{10}$ mode. If operation in both of the modes is required, the angle $\theta$ must be chosen so as to minimize $m_1^2+(m_1+m_2)^2$ and the appropriate value of $\theta$ can be determined using Equations (7) to (9).

What is claimed is:

1. An antenna arrangement comprising:

a curved offset main reflector for bidirectionally directing a wavefront between the far field of the antenna and a predetermined focal point of the reflector, the reflector including a reflecting surface comprising an axis of revolution on which the predetermined focal point is located; and a horn including (1) a first pair of opposing concentric conic wall sections associated with a common axis of symmetry and (2) a second pair of opposing planar wall sections radially aligned with said common axis of symmetry of the conic wall sections, the first and second pair of wall sections being tapered from the main reflector to intersect a common apex corresponding to the predetermined focal point of the reflector, and the common axis of symmetry of the conic wall sections is disposed at a predetermined acute angle $\theta$ to the axis of revolution of the reflecting surface of the main reflector to minimize cross-polarization in the far field of the antenna.

2. An antenna arrangement according to claim 1 wherein the angle $\theta$ is chosen to minimize cross-polarization produced by the $TE_{01}$ mode over the far field of the antenna.

3. An antenna arrangement according to claim 1 wherein the angle $\theta$ is chosen to minimize cross-polarization produced by the $TE_{10}$ mode over the far field of the antenna.

4. An antenna arrangement according to claim 1 wherein the angle $\theta$ is chosen to minimize cross-polarization produced by both the $TE_{01}$ and $TE_{10}$ modes over the far field of the antenna.

5. An antenna arrangement according to claim 1 wherein a third pair of sidewalls extend from two opposing sides of the offset main reflector to provide an aperture of the antenna which comprises two orthogonal lines of symmetry.

6. An antenna arrangement as in any one of claims 1–5 in which $\theta=90^\circ-\theta_c/2$, where $\theta_c$ equals the angle that a central ray in a beam launched by an antenna feed located at the predetermined focal point of the reflector makes with the axis of revolution of the reflecting surface of the main reflector when directed at a central point on both the reflecting surface and the far field.

* * * * *